US007047588B2

(12) United States Patent
Bennett

(10) Patent No.: US 7,047,588 B2
(45) Date of Patent: May 23, 2006

(54) TUCK POINT TOOL

(76) Inventor: Harry Bennett, 4923 Wagonwheel Dr. SE., Salem, OR (US) 97301

( * ) Notice: Subject to any disclaimer, the term of this patent is extended or adjusted under 35 U.S.C. 154(b) by 0 days.

(21) Appl. No.: 10/786,181

(22) Filed: Feb. 25, 2004

(65) Prior Publication Data

US 2005/0183224 A1 Aug. 25, 2005

(51) Int. Cl.
*E04G 21/20* (2006.01)

(52) U.S. Cl. ..... 15/105.5; 15/235.3; 33/518; D8/99

(58) Field of Classification Search ..... 15/105.5, 15/235.3, 235.4, 236.05; 425/458; 33/501.45, 33/518, 545, 548, 550, 551.1, 555.3; 7/118, 7/167, 168; 30/152, 155, 299, 312; 81/177.7; 132/73.5, 75.3, 75.5, 309; D8/99, 105; D10/61
See application file for complete search history.

(56) References Cited

U.S. PATENT DOCUMENTS

| | | | | | |
|---|---|---|---|---|---|
| 153,119 | A * | 7/1874 | Schofield | 7/118 |
| 274,570 | A * | 3/1883 | Davis | 168/48.1 |
| 352,082 | A * | 11/1886 | Cross | 15/105.5 |
| 443,387 | A * | 12/1890 | Blanchard | 15/235.3 |
| 502,872 | A | 8/1893 | Benson | |
| 541,793 | A * | 6/1895 | Schenck | 7/118 |
| 544,540 | A * | 8/1895 | Jones | 168/45 |
| 567,493 | A * | 9/1896 | McCartea | 168/45 |
| 1,039,482 | A * | 9/1912 | Bauer | 7/168 |
| 1,292,558 | A | 1/1919 | Ackerson | |
| 1,619,030 | A | 3/1927 | O'Neal | |
| 1,715,569 | A | 6/1929 | Rathjen | |
| 2,237,378 | A * | 4/1941 | Thienemann | 33/501 |
| 2,883,854 | A | 4/1959 | Marmon | |
| 3,230,566 | A | 1/1966 | Moody | |
| 3,389,420 | A | 6/1968 | Pryor | |
| 3,403,419 | A | 10/1968 | Hazelrigg | |
| 4,006,613 | A * | 2/1977 | Zion | 70/394 |
| 4,586,890 | A * | 5/1986 | Marchbanks | 425/458 |
| 4,673,346 | A * | 6/1987 | Anderson | 425/458 |
| 4,698,870 | A | 10/1987 | Clark | |
| 4,856,135 | A | 8/1989 | Stewart | |
| 5,875,558 | A * | 3/1999 | Bakke et al. | 33/501.45 |
| 2002/0162238 | A1 * | 11/2002 | Bakke et al. | 33/501.45 |

* cited by examiner

*Primary Examiner*—Randall Chin
(74) *Attorney, Agent, or Firm*—Carl D. Crowell

(57) ABSTRACT

A masonry tuck point tool has a plurality of tuck blades pivotally attached at one end. Among the tuck blades is a selected tuck blade that has the desired width of the grout or mortar joint to be formed. There are also at lease one remaining tuck blade. All tuck blades have a distinct blade width and similar blade lengths. The selected tuck blade is pivoted approximately 180 degrees away from the remaining tuck blades thereby allowing the remaining tuck blades to be used as a handle at the one end while the opposite end of the selected tuck blade is used to strike a grout or mortar joint between two adjacent masonry elements.

10 Claims, 1 Drawing Sheet

TUCK POINT TOOL

FIELD OF THE INVENTION

The present invention relates to a masonry tool and more particularly to a masonry tuck point tool for tucking a joint between adjacent masonry elements.

BACKGROUND OF THE INVENTION

It is to be understood that the terminology "masonry elements" utilized throughout the specification is to be interpreted as including bricks, cinder blocks, compressed concrete slabs, decorative tile, or the like, and the joint therebetween may be formed of mortar, grout or other similar material.

Additionally, "tucking a joint" is to be interpreted as meaning striking or finishing the joint between adjacent masonry elements.

Tuck point tools are commonly used in masonry applications. One type of tuck tool is the generally S-shaped mortar striking tool wherein each end of the tool is rounded to a different radius to accommodate two different mortar widths. Another tool is a single size plastic grout finisher which is essentially a plastic thimble.

Masonry or ceramic tile is presently used outdoors, on walls, and floors. This masonry or ceramic tile comes in a wide variety of designs; e.g. rounded, beveled or square edged, irregular shapes and spacing between adjacent masonry elements which can vary generally over the range from one-sixteenth to one-half inch in width. In an effort to accommodate this variety of grout or mortar joint widths, striking tools have been made that have multiple strike heads or tips. One such striking tool is disclosed in U.S. Pat. No. 4,698,870 to Clark. Clark describes a circular disc that has a plurality of circular projections integrally formed within the disc and arranged about the periphery of the disc. The radius of each projection is distinct from each other projection. This tool, however, to allow all projections to be functional without interference from adjacent projections, the tool must be relatively large compared to a single tool. This is inconvenient and difficult to handle.

Other tools have the ability to exchange tips or strike ends to accommodate differing grout or mortar joint widths. This type of tuck tool requires the container which houses the alternate tips to be drug around the job site with the mason in the event he needs a different size tuck tool.

There are clear convenience advantages as well as cost advantages to having a masonry tuck tool that is inexpensive to manufacture, small enough to slip into a pocket, and yet versatile enough to accommodate a multitude of grout or mortar joint widths.

SUMMARY OF THE INVENTION

The present invention is a masonry tuck point tool for tucking a grout or mortar joint in adjacent masonry elements.

The primary object of the invention is the provision of a masonry tuck point tool that accommodates a plurality of joint widths in a single tool.

Another object of the present invention is the provision of a masonry tuck tool that is inexpensive to manufacture and is conveniently small enough to store in a pocket while not in use yet is shaped such that it is easy to grasp and handle.

The foregoing as well as other objects, features, and advantages of the present invention will become more apparent from the following detailed description taken in conjunction with the appended drawings.

DETAILED DISCUSSION OF THE PREFERRED EMBODIMENTS

Referring to the figures, like elements retain their indicators throughout the several views.

Figure 1:
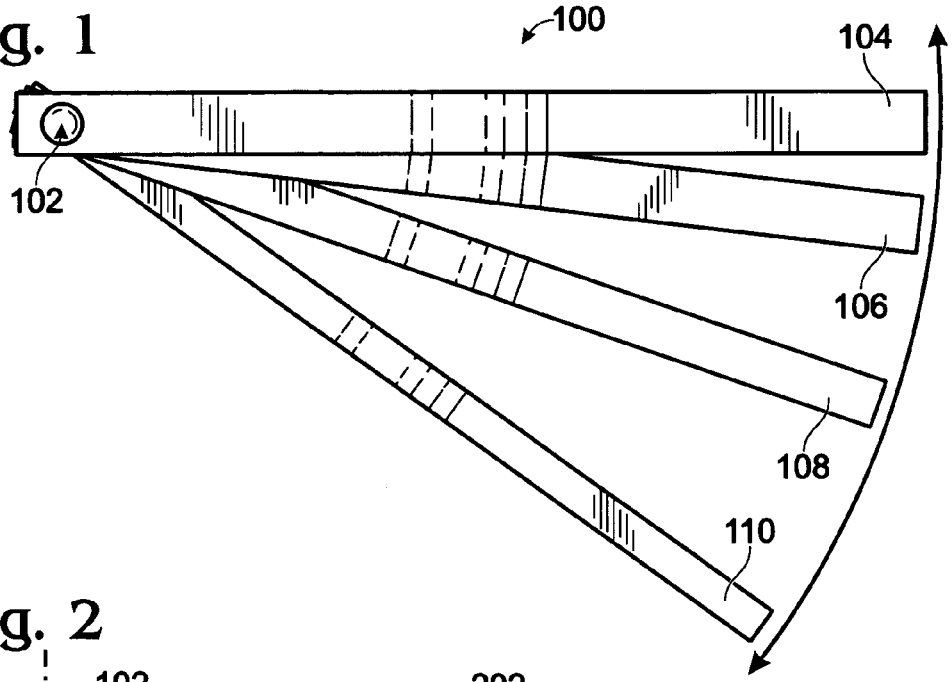
FIG. 1 is a plan view of the preferred embodiment of the present invention.

FIG. 1 is a plan view of the preferred embodiment of the present invention depicting Tuck Point Tool 100 in an open or "fanned out" state. The common widths for grout or mortar joints are ½", ⅜", ¼", and ⅛". As a result, in the preferred embodiment, Tuck Point Tool 100 has four individual tools—First Tuck Tool 104 representing the ½" width, Second Tuck Tool 106 the ⅜" width, Third Tuck Tool 108 the ¼" width, and finally, Fourth Tuck Tool 110 the ⅛". Each of the four tuck tools are pivotally attached to one another by Pivotal Component 102 disposed through one end of all of the tuck tools. When Tuck Point Tool 100 is not in use, all four tuck tools are slid together or stacked so they can be easily slipped into a jacket, shirt, or pants pocket similar to the stowing of a pen. When the mason wants to use one of the tuck tools, he simply rotates the needed tuck tool 180 degrees away from the remaining three tuck tools. This allows the desired grout or mortar joint to be struck or formed with the chosen tuck tool while the remaining three tuck tools are used as a handle.

Although the preferred embodiment of Tuck Point Tool 100 has four tuck tools, it is conceivable that Tuck Point Tool 100 could have any number of tuck tools depending on the potential application widths.

Figure 2:
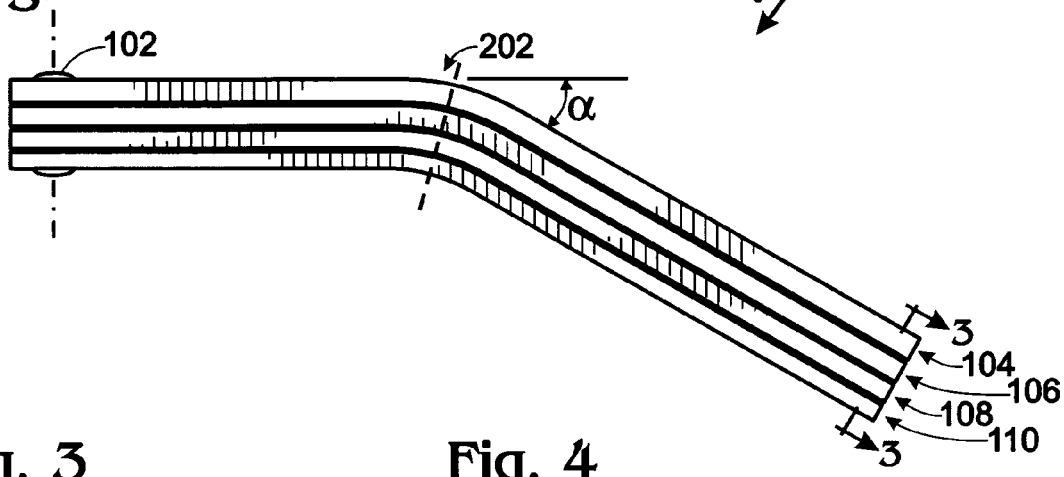
FIG. 2 is a side view of the preferred embodiment of the present invention.

FIG. 2 is a side view of the preferred embodiment of the present invention. In FIG. 2, Tuck Point Tool 100 is shown closed or stacked where First Tuck Tool 104, Second Tuck Tool 106, Third Tuck Tool 108, and Fourth Tuck Tool 110 are stacked parallel to one another and pivotally attached by Pivotal Component 102. Tuck Point Tool 100 is shown to include a bend 202 at an angle alpha. Preferably alpha is approximately 20 to 35 degrees. This bend 202 in Tuck Point Tool 100 aids in the handling and maneuvering of the tool as well as makes it easier to remove from a pocket. This bend 202 being uniform for all nested Tuck Tools, 104, 106, 108, 110 as depicted in FIG. 2, permits the parallel stacking of the remaining tuck tools to be used as a handle. Tuck Point Tool 100 is preferably made of rigid, heavy spring steel, but could conceivably be made from other rigid metals, or a hard plastic.

Figure 3:
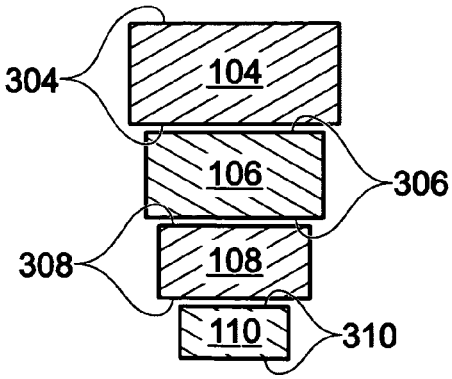
FIG. 3 is a cross-section taken at line 3—3 of FIG. 2 of the preferred embodiment of the present invention.

FIG. 3 is a cross-section taken at line 3—3 of FIG. 2 of the preferred embodiment of the present invention. FIG. 3 shows a profile of each tuck tool. For example, First Tuck Tool Surfaces 304 of First Tuck Tool 104 would both give a flat grout or mortar joint upon striking. In other words, when the tuck tool is drug along the gap between two adjacent masonry elements, a flat or squared joint will be created. On any of the four tuck tools, either side of the corresponding tuck shape can be used. For example, Second Tool Tuck Shape 306 will leave a flat or squared joint when Second Tuck Tool 106 is selected. When one side of Tool Tuck Shape 306 is rounded or no longer of the desired shape, the opposite, or good, side of Tool Tuck Shape 306 can be utilized by rotating Tuck Point Tool 100 by 180 degrees.

Figure 4:
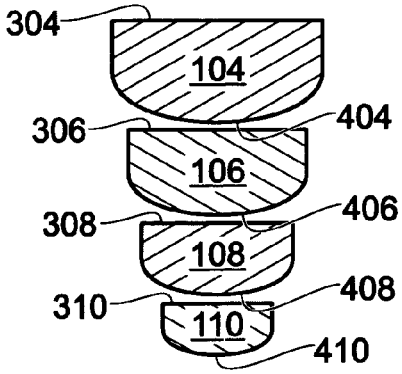
FIG. 4 is a cross-section taken at line 3—3 of FIG. 2 of an alternate embodiment of the present invention.

FIG. 4 is a cross-section taken at line 3—3 of FIG. 2 of an alternate embodiment of the present invention. In this alternate embodiment, each Tuck Tool has both a flat and a rounded tool tuck shape. For example, First Tuck Tool 104 is shown with a flat First Tool Tuck Shape 304 as in the previous drawing, but the opposite surface, First Tool Tuck Second Shape 404 is rounded and would strike or tuck a somewhat scooped out or rounded grout or mortar joint between the adjacent masonry elements.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

I claim:

1. A masonry tuck point tool comprising:

a selected tuck blade and at least one remaining tuck blade pivotally attached at a first end, said selected tuck blade and each of said at least one remaining tuck blade having a distinct blade width, wherein said selected tuck blade is pivoted approximately 180 degrees away from said at least one remaining tuck blade thereby allowing said at least one remaining tuck blade to be used as a handle at said first end while said selected tuck blade is utilized for striking a masonry joint with a second end opposite said first end of said at least one remaining tuck blade, wherein said selected tuck blade and said at least one remaining tuck blade are uniformly bent and nested to permit parallel stacking.

2. The masonry tuck point tool of claim 1, wherein said selected tuck blade and said at least one remaining tuck blade are rigid spring steel.

3. The masonry tuck point tool of claim 1, wherein said selected tuck blade and said at least one remaining tuck are hard plastic.

4. The masonry tuck point tool of claim 1, wherein said selected tuck blade and said at least one remaining tuck blade are bent at an approximately 35 degree angle across said blade width between said first end and said second end.

5. The masonry tuck point tool of claim 4, wherein said angle is approximately equidistant between said first end and said second end.

6. The masonry tuck point tool of claim 1, wherein said selected tuck blade and said at least one remaining tuck blade are of distinct lengths.

7. The masonry tuck point tool of claim 1, wherein said selected tuck blade and said at least one remaining tuck blade are bent at an angle of approximately between 20 and 35 degrees across said blade width between said first end and said second end.

8. The masonry tuck point tool of claim 7, wherein said angle is approximately equidistant between said first end and said second end.

9. The masonry tuck point tool of claim 1, wherein said selected tuck blade and said at least one remaining tuck blade have similar blade lengths.

10. A masonry tuck point tool, comprising:

a selected tuck blade and an at least one remaining tuck blade pivotally attached at a first end, said selected tuck blade and each of said at least one remaining tuck blade having a distinct blade width, wherein said selected tuck blade is pivoted approximately 180 degrees away from said at least one remaining tuck blade thereby allowing said at least one remaining tuck blade to be used as a handle at said first end while said selected tuck blade is utilized for striking a masonry joint with a second end opposite said first end of said at least one remaining tuck blade, wherein said selected tuck blade and said at least one remaining tuck blade are uniformly bent and nested at an angle of from 20 to 35 degrees between said first end and said second end to permit parallel stacking.

* * * * *